US006155037A

United States Patent [19]

Madone

[11] Patent Number: 6,155,037

[45] Date of Patent: Dec. 5, 2000

[54] REVOLVING BODY FOR INSERTING FALSE TWIST INTO YARN OR THE LIKE

[75] Inventor: Diego Madone, Hombrechtikon, Switzerland

[73] Assignee: Zellweger Luwa AG, Uster, Switzerland

[21] Appl. No.: 09/203,345

[22] Filed: Dec. 2, 1998

[30] Foreign Application Priority Data

Dec. 3, 1997 [CH] Switzerland ..... 2780

[51] Int. Cl.[7] ..... D01H 1/24

[52] U.S. Cl. ..... 57/334; 57/62; 57/66; 57/77.4; 57/80

[58] Field of Search ..... 57/34, 62, 66, 57/77.3, 77.4, 80, 318, 338, 341, 334, 335, 332, 337, 342, 344

[56] References Cited

U.S. PATENT DOCUMENTS 4,010,599 3/1977 Luthi ..... 57/334
4,027,467 6/1977 Smith ..... 57/77.4
4,115,986 9/1978 Bieniok et al. ..... 57/77.3
4,204,394 5/1980 Luthi ..... 57/334

FOREIGN PATENT DOCUMENTS 25 08 567 10/1975 Germany .
283673 3/1964 Netherlands .

*Primary Examiner*—John J. Calvert
*Assistant Examiner*—Mary K. Fiore
*Attorney, Agent, or Firm*—Burns, Doane, Swecker & Mathis

[57] ABSTRACT

A revolving body (1) with a circumferential surface (2) and two end faces is provided for inserting twist into a midportion of a longitudinally moving elongate strand of filamentary material. In order to produce a revolving body into which the elongate strand can be introduced very easily and which is also suitable for automated introduction of the strand, this body is provided with a groove which is open towards the circumferential surface and the end face so as to take up the elongate strand in the region of a longitudinal axis and is configured to deflect the strand away from the longitudinal axis.

21 Claims, 6 Drawing Sheets

Fig. 6
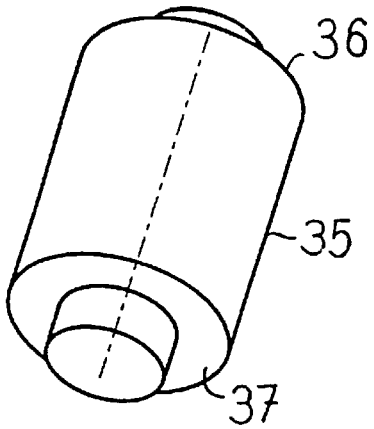
Fig. 7
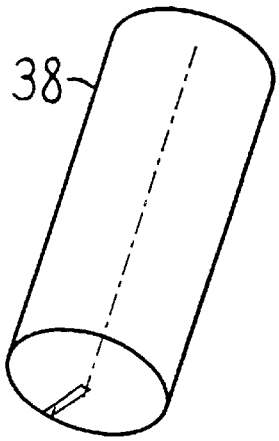
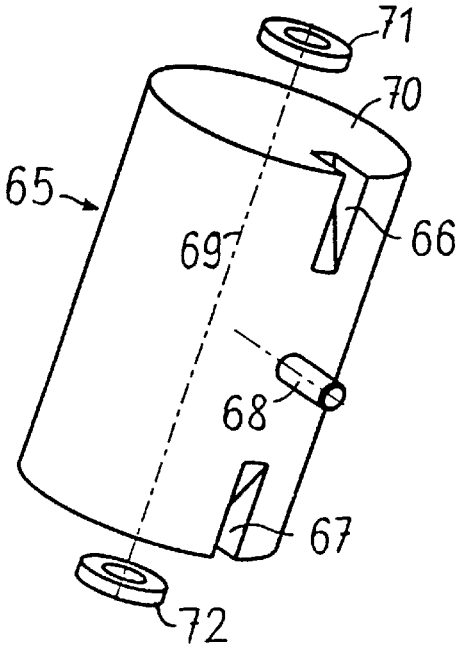
Fig. 17
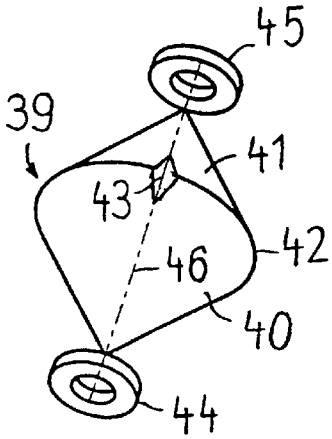
Fig. 8

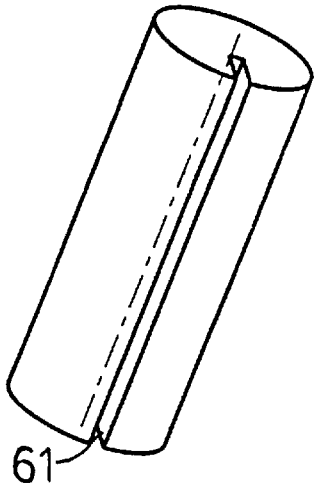
Fig. 13
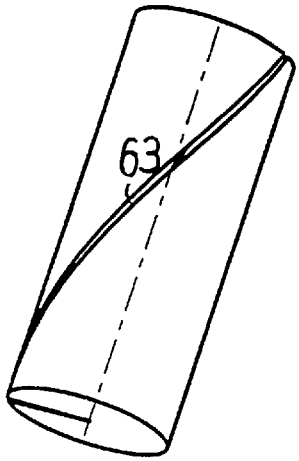
Fig. 15
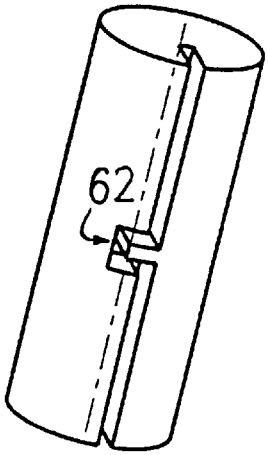
Fig. 14
Fig. 16
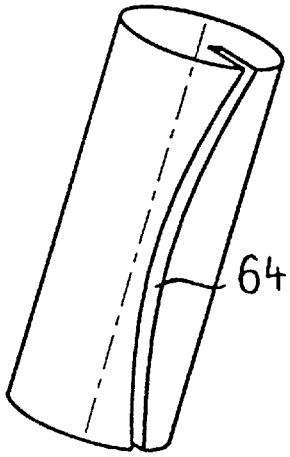

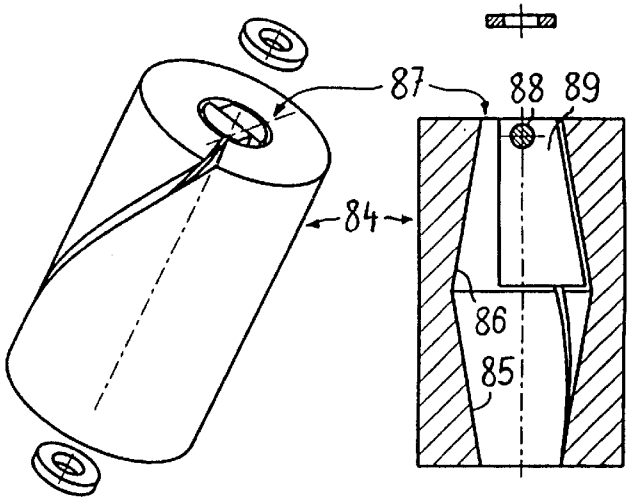
Fig. 19
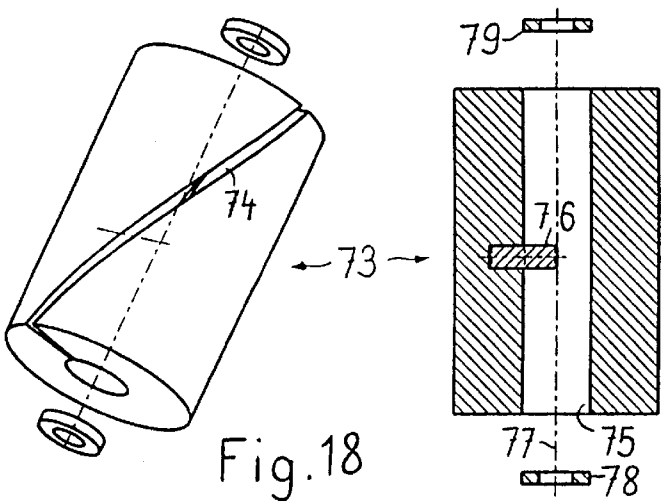
Fig. 18
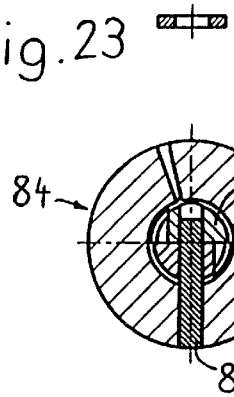
Fig. 24
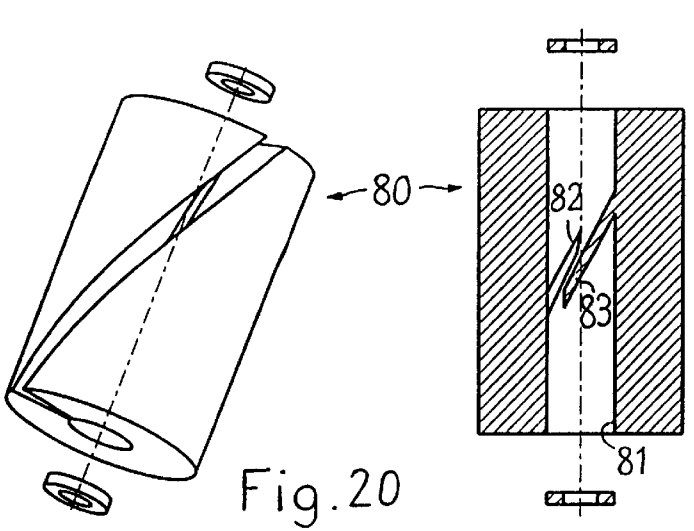
Fig. 20
Fig. 22
Fig. 23
Fig. 21

REVOLVING BODY FOR INSERTING FALSE TWIST INTO YARN OR THE LIKE

FIELD OF THE INVENTION

The invention relates to the insertion of twist into portions of yarns or other elongate filamentary strands as such strands move continuously along a path. In particular, the invention is concerned with a revolving body for contacting a strand to insert twist as the strand moves longitudinally along its lengthwise extent. Such a revolving body may be used in the production of textile products such as texturized yarns or in laboratory testing operations.

BACKGROUND

False twist apparatus such as twist tubes have long been known in connecting with the processing of filamentary materials. See for example, U.S. Pat. No. 4,115,986 (the entire disclosure of which is incorporated herein by reference), which describes a revolving tube for producing a so called false twist in a device for texturing textile yarns. In this case the yarn passes through the revolving tube in its longitudinal direction, although is guided around a mandrel disposed approximately in the center of the tube. As the tube is made to revolve, the yarn is twisted. In order to thread-in or introduce the yarn before texturing, it must be introduced into an axial hole at one end face of the revolving tube, looped once around the mandrel and guided out again.

The known revolving bodies of this kind may well be suitable for continuous processes, but they present a disadvantage in cases where yarn processing operations of short duration are concerned. In such cases too much time is taken up by threading one end of the yarn into the revolving tube. Although it would be possible to eliminate this disadvantage by means of an automatic threading device, this ultimately results in a very expensive solution to the problem.

SUMMARY OF THE INVENTION

The present invention has as an object the provision of a revolving body into which an elongate strand, be it an elongate test specimen or an elongate production product, can be introduced very easily, and which not only enables a high-grade twist to be inserted but also is suitable for automated introduction of the strand being handled into the proper positional relation to the features of the revolving body.

According to the invention, the revolving body comprises a groove into which a midportion of the length of the elongate strand to be twisted may be introduced from outside.

It should be understood that the elongate strand to be twisted may be an assembly of fibers, a filament or group of filaments, a yarn, or other flexible body of great length which is being moved longitudinally along its length while the twist is being introduced. Both textile product production operations and measuring or testing operations are contemplated. For the sake of simplicity of reference, it will be convenient herein to refer to the elongate body of material into which twist is to be inserted as the "elongate strand" without limitation as to particulars of the material and whether production or testing is taking place.

The elongate strand is deflected away from the longitudinal axis of the revolving body either through the shape of the actual groove or through elements such as pins, webs, entrainment devices, etc. specially provided for this purpose. The groove is preferably open towards the circumferential surface and the end faces and is of a variable depth, which is greater in the region of the end faces and smaller in the region of the circumferential surface.

The advantages achieved through the invention lie in particular in the fact that a revolving body of this kind can be produced by relatively simple working steps and is therefore not very expensive. It is in addition suitable for automatic introduction of the elongate strand, as the latter can enter it from the circumferential surface. The elongate strand can in this respect additionally be moved in its longitudinal direction, which means that a revolving body of this kind can also be subsequently brought into a process already running. Very high twist insertion degrees can be achieved with revolving bodies of this kind, for a so-called twist run back extending beyond the revolving body is produced. The revolving body according to the invention also enables the extent of twist insertion to be easily adjusted. This is effected by coordinating the tension of the elongate strand, the revolutions per minute of the revolving body and, in some instances, other influencing variables such as the form of the groove or the form of the deflection means.

BRIEF DESCRIPTION OF THE DRAWINGS

The invention is illustrated in detail in the following on the basis of an example and with reference to the accompanying figures, in which:

FIGS. 6 to 24 are further possible constructions of a revolving body.

DETAILED DESCRIPTION OF THE PREFERRED EMBODIMENTS

Figure 1:
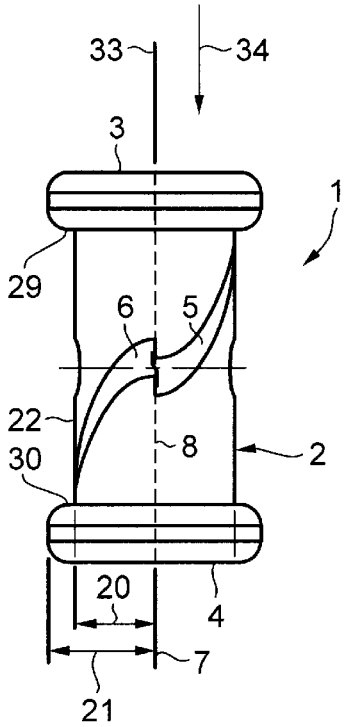
FIG. 1 is a side view of a revolving body.

FIG. 1 shows the revolving body 1 with its circumferential surface 2, which here is cylindrical, and plane end faces 3 and 4. A groove 5, 6 can be seen here from its open side. It extends from the end face 3 to the end face 4. Also shown are an elongate strand 7 and a longitudinal axis 8 for the revolving body 1. The circumferential surface 2 is at a distance 21 from the longitudinal axis 8 in the region of the end face 3, 4 which is greater than a distance 20 as can be measured in a section 22 further away from the end faces 3 and 4. This results in shoulders 29 and 30 at the circumferential surface 2.

Figure 2:
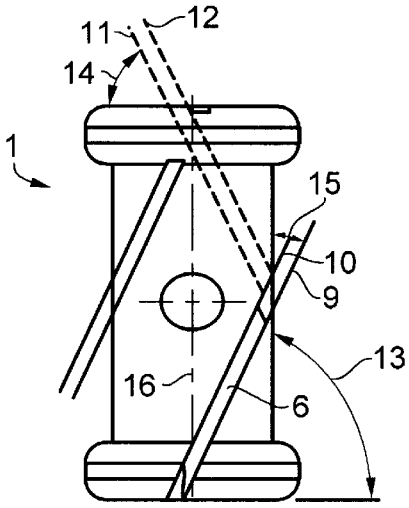
FIG. 2 is another side view of a revolving body.
Figure 3:
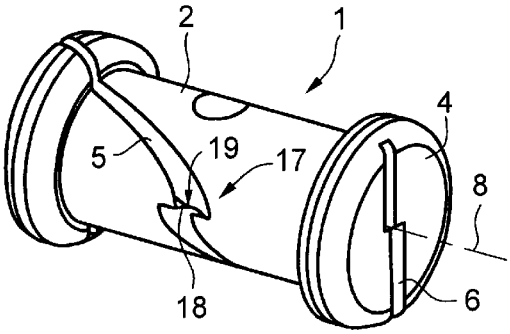
FIGS. 3 and 4 are perspective views of a revolving body.

FIG. 2 shows the same revolving body 1 from a direction which is turned through 90° in relation to the direction according to FIG. 1. Planes which are represented by lines 9 and 10 as well as 11 and 12 and which here are perpendicular to the plane of the drawing, for example, can be seen in this figure. The groove 6 is in this case bounded at the sides by the planes 9 and 10 and the groove 5 by the planes 11 and 12, the planes 9 and 10 being inclined by an angle 13 and the planes 11 and 12 by an angle 14 towards the end faces 4 and 3, respectively. As shown in FIGS. 2 and 3 the angles are such that overall groove 5, 6 wraps about half way around the body to intersect the end faces 3 and 4 at locations spaced circumferentially from each other about 180 degrees. These planes 9 to 12 are also inclined towards the circumferential surface 2 and form with the latter an angle 15, for example. Assuming that here the line 16 represents a plane of symmetry of the revolving body 1, it can also be seen here that the planes 9, 10, 11 and 12 intersect the end faces 4, 3 in the region of this plane of symmetry 16.

FIG. 3 is a perspective view, again of the revolving body 1. It is in particular evident in this case that the groove, here the groove 6, extends or can extend in the region of the end face 4 into the revolving body 1 as far as the region of the longitudinal axis 8, or even beyond this. However the groove 6 is not very deep in a region 17 of the circumferential surface 2, this being obvious from the fact that one side wall 18 of the groove 6 is very low. The groove 6 also passes into the groove 5 in this region 17, this taking place here in particular via a web 19 which, although being part of the groove 5, 6, forms the actual means for deflecting the elongate strand. The grooves 5 and 6 are staggered slightly in the region 17.

Figure 4:
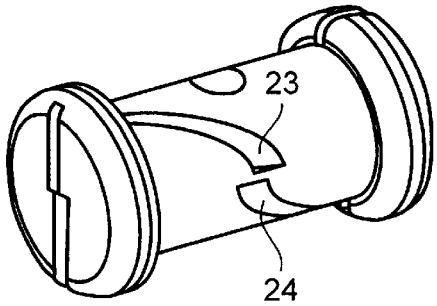

FIG. 4 shows the revolving body 1 from another side, from which further, third and fourth grooves 23, 24 are evident. These are disposed symmetrically with respect to the grooves 5 and 6 and serve to prevent unbalance, i.e. to provide mass balancing. The revolving body may obviously also be balanced by other means, thus rendering the grooves 23, 24 unnecessary.

Figure 5:
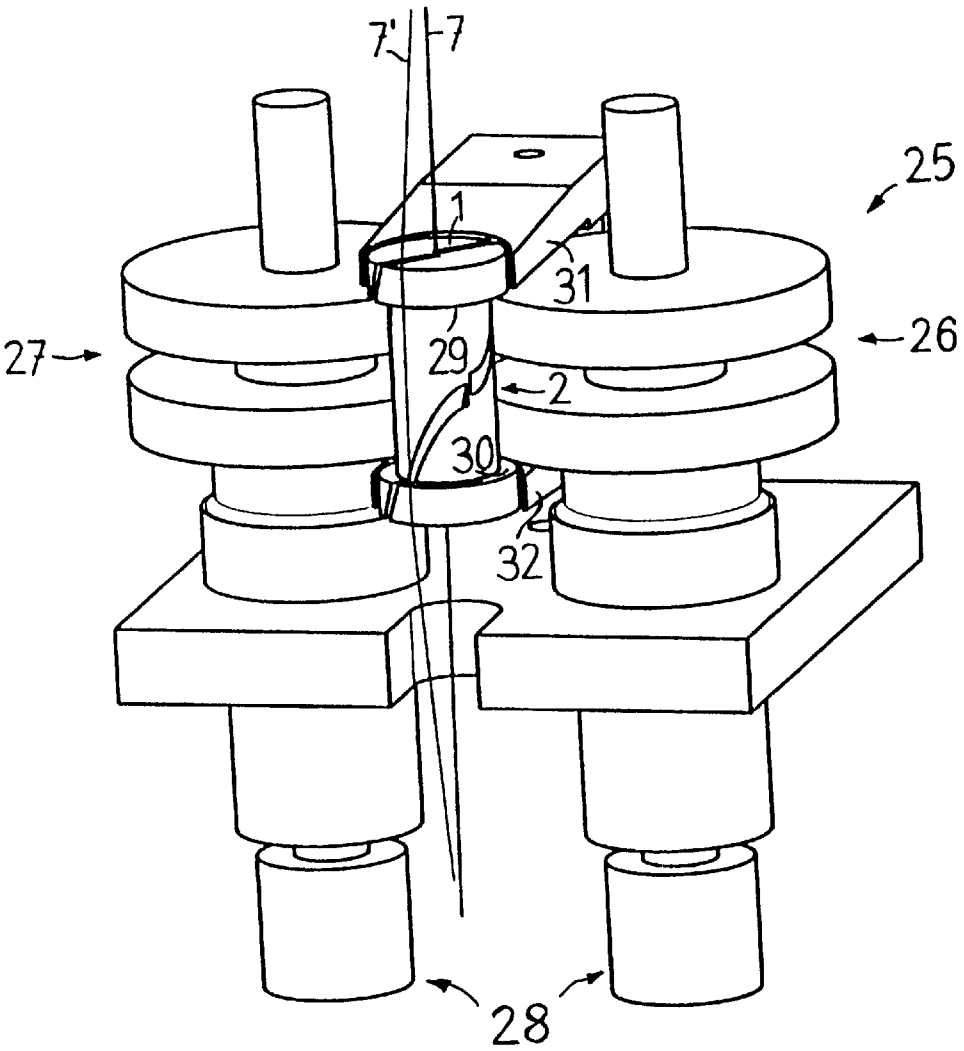
FIG. 5 shows a revolving body with a mounting and a drive.

FIG. 5 shows a device 25 for mounting and driving the revolving body 1. This comprises in particular two friction wheels or friction wheel pairs 26 and 27 with a drive 28. The revolving body 1 lies on the friction wheel pairs 26, 27 and is centered on the latter in its longitudinal direction via the shoulders 29, 30. The revolving body 1 is pressed against the friction wheel pairs 26, 27 by magnets 31, 32 transversely to the longitudinal direction. However the revolving body could also be pressed against the friction wheel pairs 26, 27 by a third wheel pair, which is not shown here, or another means.

The invention operates in the following mode. The elongate strand 7', which is moved longitudinally and which in this case is a yarn, for example, is guided from outside towards the circumferential surface 2 of the revolving body 1, so that the elongate strand 7' is deflected by the revolving body 1. The revolving body 1 is then made to revolve by the friction wheel pairs 26, 27, while the elongate strand 7' is preferably additionally guided laterally. As soon as the groove 5, 6 is next to the elongate strand 7', this is drawn by the revolving movement and by its own longitudinal movement into the groove 5, 6 and thus into the revolving body 1, so that the elongate strand 7' now takes up the position of the elongate strand 7. The elongate strand 7 now passes through the groove 5, 6, being deflected away from the longitudinal axis 8 at one point by approximately a distance 20. This causes the elongate strand 7 to twist in a region 33 (FIG. 1) outside of the revolving body 1. The region 33 lies before the entry into the revolving body 1, which means that the elongate strand 7 moves in the direction of an arrow 34.

This twisting of the elongate strand 7 before it enters the revolving body may be desirable when continuously measuring properties of the elongate strand. These revolving bodies may therefore also be used when measuring filaments, yarns and other elongate strands moving longitudinally, and not just when processing filaments, for example. The revolving body 1 may therefore be used for measuring purposes and for processing yarns, filaments, etc.

The revolving body which has been described above and which is of a preferred design, may of course take on other forms, which are illustrated in the figures described in the following, while maintaining the essential features and function.

FIG. 6 shows a base body 35 for a revolving body which is likewise suitable for introduction between the friction wheel pairs 23, 24 of the device according to FIG. 5. In this case the spacing of the friction wheel pairs would possibly have to be greater, as they would have to act on shoulders 36, 37 of the revolving body. Although it is not shown here, this base body 35 also comprises a groove which upgrades it to a revolving body.

FIG. 7 shows a straight, cylindrical revolving body 38 without shoulders but with a groove, as indicated at its intersection with the end face of the cylinder.

FIG. 8 shows a revolving body 39 comprising two conical circumferential surfaces 40 and 41 which intersect at a circle 42. A groove 43 is provided in the region of the circle 42, through which groove the elongate strand passes, so that this is deflected and made to twist by the revolving body 39 revolving about its axis 46. This revolving body 39 co-operates with two rings 44 and 45, which are stationary with respect to the body and which center the elongate strand in the region of the axis 46.

Figure 9:
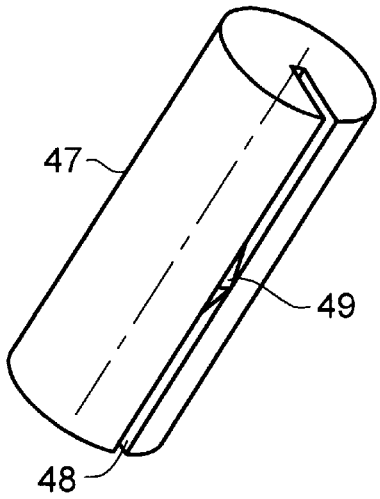
Figure 10:
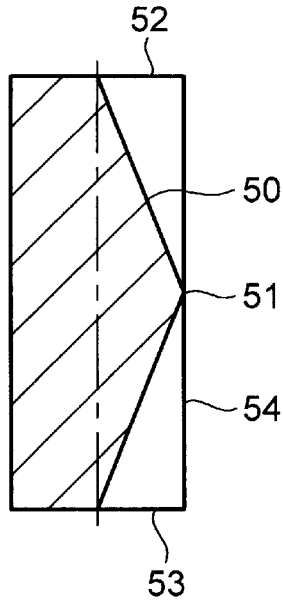

FIG. 9 shows a cylindrical revolving body 47 with a straight groove 48, into which a means 49 for deflecting the elongate strand is fitted. As shown by FIG. 10, this means 49 may consist in deepening the bottom 50 of the groove 48 from a point 51 in the region of the circumferential surface 54 towards the end faces 52, 53 and thus deflecting the elongate strand towards the circumferential surface 54.

Figure 11:
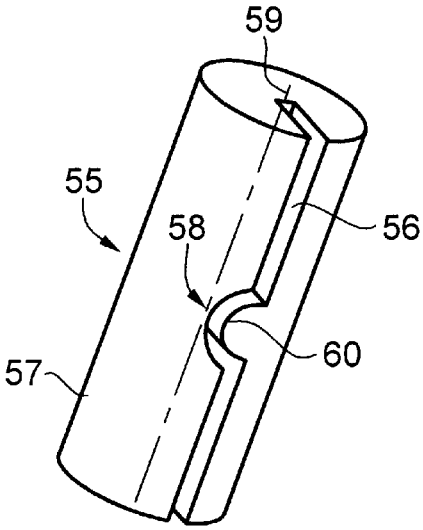
Figure 12:
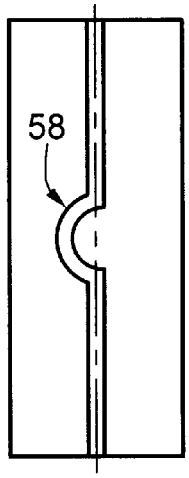

FIG. 11 shows a revolving body 55 with a straight groove 56, which comprises a region 58 deflected in the direction of the circumferential surface 57. This region 58 can also be seen in FIG. 12. FIG. 11 shows how the groove 56 extends to the axis 59. Here too a means 60 for deflecting the elongate strand into the region of the circumferential surface is provided, so that the elongate strand is twisted as a result of the revolving body 55 revolving.

FIG. 13 again shows just a straight groove 61, and FIG. 14 the same groove into which a baffle 62 is fitted. As the groove 61 does not in this case extend as far as the center, the elongate strand is deflected over the entire length of the groove 61 and twisted as a result of the rotation of the revolving body.

FIG. 15 shows a spiral groove 63 and FIG. 16 an arcuate groove 64. Here too the extent of the two grooves 63, 64 into the center is such that the operating mode corresponds to that of the revolving bodies according to FIGS. 13 and 14.

FIG. 17 shows another construction of a revolving body 65 with two short grooves 66, 67 and with an entrainment device 68 optionally provided for the elongate strand. As the grooves 66, 67 are not formed such that the elongate strand is held on the end faces 70 in the region of the axis 69, the known, axially disposed rings 71, 72 are provided.

FIGS. 18 and 19 show a revolving body 73 with a spiral groove 74 and a hole 75. Here the groove 74 simply serves to introduce the elongate strand from the circumferential surface into the hole 75, in which hole 75 a pin 76 around which the elongate strand is guided is disposed. The elongate strand is thus deflected away from the axis 77. The use of rings 78, 79 outside of the revolving body 73 is advisable here.

FIGS. 20 and 21 show a revolving body 80 according to FIGS. 18 and 19, with the difference that two, eccentrically directed entrainment devices 82, 83 are disposed in the bore 81 to deflect the elongate strand.

FIGS. 22, 23 and 24 show a revolving body 84 with two conical inner faces 85, 86. A pin 88 is set in the revolving body 84 near the entry 87, on which pin a displacement body 89 is pivotably mounted. An end piece 90 prevents the displacement body 89 from shifting axially on the pin 88. During operation the elongate strand is urged by the displacement body 89, which swings out under the effect of the centrifugal force, against the inner face 86 and is gripped lightly, so that the elongate strand is twisted in the known manner.

All the illustrated constructions comprise at least one groove into which the elongate strand can be introduced from outside and which provides access to means for deflecting the elongate strand. The elongate strand may in this respect be deflected away from the axis directly by the actual groove or by other means, obtaining access to the said means via the groove. The illustrated revolving bodies are suitable for elongate strands which are moved longitudinally, so that the twist is influenced by the revolving movement of the revolving body and the longitudinal movement of the elongate strand. All these revolving bodies are also suitable for inserting a twist in the elongate strand in the processing sense, which means that the elongate strand discussed here is then an intermediate product or is processed from a primary product into a product in the revolving body.

What is claimed is:

1. A revolving body (1) for inserting false twist into an elongate strand, said revolving body comprising a circumferential surface (2) and two end faces (3, 4), and having therein a groove (5, 6), which is open towards the circumferential surface and takes up said elongate strand (7), and means (5, 6, 19) for deflecting the elongate strand.

2. A revolving body according to claim 1, wherein said groove provides access to said means for deflecting, is open towards an end face, and extends at least in part inwardly towards an axis (8) of the revolving body.

3. A revolving body (1) for inserting false twist into an elongate strand, said revolving body comprising a circumferential surface (2) and two end faces (3, 4), and having therein a groove (5, 6,), which is open towards the circumferential surface and takes up said elongate strand (7), and means (5, 6, 19) for deflecting the elongate strand, said groove including a first groove part (5) extending along a first plane (11, 12) and a second groove part (6) extending along a second plane (9, 10), and both planes being inclined both towards one another and towards the end faces.

4. A revolving body according to claim 3, wherein said first plane intersects one end face and said second plane intersects the other end face in the region of a plane of symmetry (16) of the revolving body.

5. A revolving body according to claim 3, wherein said first and second groove parts extend in the region of the end face from the circumferential surface into the region of a longitudinal axis of the revolving body, and wherein the same groove parts in a region (17) remote from the end faces are spaced away from said longitudinal axis toward the circumferential surface (2).

6. A revolving body according to claim 5, wherein said first groove part (5) passes into the second groove part (6) in the region of the circumferential surface, and wherein the depth of the first and the second groove parts continuously decreases between the end faces and the circumferential surface.

7. A revolving body according to claim 2, wherein said circumferential surface is at its greatest distance (21) from the longitudinal axis in the region of the end faces.

8. A revolving body according to claim 3, wherein third and fourth groove parts (23, 24) are provided along respective planes parallel to said first and the second groove parts.

9. A method for inserting false twist into an elongate strand comprising providing a revolving body having a circumferential surface (2), two end faces (3, 4), a groove (5, 6), which is open towards the circumferential surface, and means (5, 6, 19) for deflecting the elongate strand; rotating said revolving body with a midportion of the elongate strand disposed in said groove; and simultaneously feeding said elongate strand in its lengthwise direction, thereby inserting twist into the portion of said strand which leads toward said rotating body.

10. A method according to claim 9, additionally comprising carrying out a measurement of at least one property of the elongated strand in the twisted part of the strand.

11. A revolving body for inserting a false twist in a portion of a longitudinally advancing elongate strand, said revolving body comprising longitudinally spaced-apart first and second end faces and a circumferential surface disposed around an axis of rotation extending between said end faces;

said circumferential surface having first and second longitudinal groove portions therein for receiving the longitudinally moving strand, said first groove portion substantially intersecting said axis at said first end face and being displaced from said axis at another location spaced axially from said first end face, and said second groove portion substantially intersecting said axis at said second end face and being displaced from said axis at another location spaced axially from said second end face.

12. In apparatus for measuring a longitudinally moving filamentary test specimen while false twist is inserted into such specimen, the improvement which comprises a rotatable body into the interior of which a midportion of the length of the test specimen can be introduced and drive means for rotating said body to false-twist the specimen; said rotatable body having end faces, having a circumferential surface adapted to contact and be frictionally driven by said drive means and having a groove therein which is displaced from the axis of rotation of the body at a midportion of the length of the body but substantially intersects such axis at the end faces of the body, whereby, upon rotation of the body, a midportion of the test specimen within the body is revolved about said axis to insert false twist into the specimen.

13. The apparatus of claim 12, wherein said groove is shallower at a midportion thereof than at its ends.

14. The apparatus of claim 12, wherein said groove is of substantially uniform depth and has a circumferentially extending midportion.

15. The apparatus of claim 12, including a first groove part extending along a first plane and a second groove part extending along a second plane, with both planes being inclined both towards one another and towards the end faces of the rotatable body.

16. The apparatus according to claim 12, wherein said rotatable body is provided with additional groove portions that do not receive the yarn but are disposed so as to maintain the mass symmetry of the rotating body.

17. A generally cylindrical body for inserting false twist into a longitudinally advancing elongate strand upon rotation of said body about its longitudinal central axis, said body comprising first and second end faces longitudinally spaced apart from one another, and a circumferential surface extending between said end faces and being provided with a groove open towards the circumferential surface for taking in the strand to be twisted, said groove extending angularly about said longitudinal axis, intersecting both of said end faces, having a depth at said end faces sufficient to extend approximately to the location of said central axis, and having a mid-portion displaced radially from said central axis toward said circumferential surface to displace a portion of the path of the longitudinally moving strand away from said axis so that, upon rotation of said body, a portion of the strand revolves about said axis and false twist is inserted into the strand.

18. A generally cylindrical body for inserting false twist according to claim 17, wherein said circumferential surface includes a middle portion located between spaced apart end portions having greater diameters than said middle portion.

19. A generally cylindrical body for inserting false twist according to claim 17, wherein said angularly extending groove intersects said first and second end faces at locations spaced circumferentially from each other about 180 degrees.

20. A generally cylindrical body for inserting false twist according to claim 17, additionally including mass balancing means for counteracting rotational imbalance due to said groove.

21. A generally cylindrical body for inserting false twist according to claim 20, wherein said mass balancing means comprises at least one symmetrically disposed additional groove.

* * * * *